US008873762B2

(12) United States Patent
Samsudin et al.

(10) Patent No.: US 8,873,762 B2
(45) Date of Patent: Oct. 28, 2014

(54) SYSTEM AND METHOD FOR EFFICIENT SOUND PRODUCTION USING DIRECTIONAL ENHANCEMENT

(75) Inventors: Samsudin, Singapore (SG); Sapna George, Singapore (SG)

(73) Assignee: STMicroelectronics Asia Pacific Pte Ltd, Singapore (SG)

( * ) Notice: Subject to any disclaimer, the term of this patent is extended or adjusted under 35 U.S.C. 154(b) by 427 days.

(21) Appl. No.: 13/210,048

(22) Filed: Aug. 15, 2011

(65) Prior Publication Data

US 2013/0044894 A1 Feb. 21, 2013

(51) Int. Cl.

| | |
|---|---|
| ***H04R 5/00*** | (2006.01) |
| ***H04S 7/00*** | (2006.01) |
| ***H04R 3/00*** | (2006.01) |
| *H04R 5/027* | (2006.01) |

(52) U.S. Cl.

CPC ..... *H04R 3/005* (2013.01); *H04R 5/027* (2013.01); *H04S 7/30* (2013.01); *H04S 2420/07* (2013.01); *H04S 2400/15* (2013.01)

USPC ..... 381/17; 381/1; 381/92; 381/307

(58) Field of Classification Search

USPC ..... 381/1, 17, 22–23, 92, 307; 704/500, 704/201, 203

See application file for complete search history.

(56) References Cited

U.S. PATENT DOCUMENTS

| | | | | |
|---|---|---|---|---|
| 6,608,903 | B1 * | 8/2003 | Miyazaki et al. | 381/17 |
| 7,787,638 | B2 * | 8/2010 | Lokki et al. | 381/92 |
| 7,856,106 | B2 * | 12/2010 | Bruno et al. | 381/17 |
| 2010/0169102 | A1 | 7/2010 | Samsudin et al. | |
| 2011/0164756 | A1 * | 7/2011 | Baumgarte et al. | 381/22 |
| 2012/0093337 | A1 * | 4/2012 | De Sena et al. | 381/92 |
| 2012/0143601 | A1 * | 6/2012 | Beerends et al. | 704/207 |

OTHER PUBLICATIONS

Berouti et. al (1979) "Enhancement of Speech Corrupted by Acoustic Noise"; Proc. IEEE Int. Conf. Acoust., Speech, Signal Process.; 208-211.

Faller (2007) "A Highly Directive 2-Capsule Based Microphone System"; AES 123rd Convention, New York, NY; 1-9.

Furness (1990) "Ambisonics—An Overview"; Proc. of AES 8th International Conf., Washington, D.C.; 181-190.

Gundry (2001) "A New Active Matrix Decoder for Surround Sound"; Proc. of AES 19th International Conf., Schloss Elmau, Germany; 1-9.

Josephson Engineering (2005) "Series Seven Users Guide"; 1-9.

* cited by examiner

*Primary Examiner* — Disler Paul

(74) *Attorney, Agent, or Firm* — Graybeal Jackson LLP

(57) ABSTRACT

A system and method for generating virtual microphone signals having a particular number and configuration for channel playback from an intermediate set of signals that were recorded in an initial format that is different from the channel playback format. In one embodiment, an initial set of intermediate are Bark-banded such that each intermediate signal may lead to a corresponding power spectral density (PSD) signal representative of the initial intermediate signal. Further, one may generate cross-correlations signals for each pair of intermediate signals. Next, from the PSDs and cross correlations, one may more efficiently calculate corresponding channel signals to be used for playback on respective channel speakers. Thus, the PSDs of each channel signal may be generated at chosen angles (as well as other design factors). Further, each channel signal may also be further modified with a corresponding cancellation signal that further enhances the resultant signal in each channel.

40 Claims, 4 Drawing Sheets

SYSTEM AND METHOD FOR EFFICIENT SOUND PRODUCTION USING DIRECTIONAL ENHANCEMENT

BACKGROUND

Many recording devices for audio and video include two or more microphones for recording sound from different directions. With recorded audio from different directions, one can reproduce sound on specific channels in common surround-sound channel formats. In this manner, the audio recorded may be played back to simulate the original conditions in which a person perceives the sound. For example, a typical surround-sound recording camera may include one or more microphones suited to record sound from specific directions. Thus, one example of an application specific recording device may include five directional microphones (often called cardioid or hypercardioid) pointed in five different direction (from the perspective of the camera) to record audio to be played back on a common 5.1 surround sound arrangement (i.e., a center channel, left/right channels and left/right rear channels corresponding to the "5" and a low-frequency omni-directional signal corresponding to the "0.1"). That is, the recording camera may include directional microphones to record sound from a center channel direction (e.g., the center channel microphone is pointed straight on at 0°s), a right channel direction (e.g., slightly right on at 30°s (with respect to a point source facing the center channel at 0°s)) a left channel direction (e.g., slightly left at 330°s), a right rear channel (e.g., at 110°s) and a left rear channel (e.g., at 250°s).

With recording audio as audio signals using directional microphones at the camera location, each audio recording may be played back on a speaker corresponding to the recorded direction wherein playback speakers (i.e., channels) are similarly arranged. As a result, a person watching playback at the simulated position of the camera will hear sound as it was recorded by each directional microphone as it is now played back through a respective speaker in a respective position.

However, as recording devices become smaller and compact, the luxury of using five or more separate directional microphones for recording audio may no longer be feasible given size and processing restraints. Additionally, because of the desire to have flexibility in audio playback across different channel formats, industry standards have developed for recording audio in specific audio formats that may be later manipulated to produce audio signals that simulate the position of a microphone. Thus, even if during original audio recording, there is no specific directional microphone pointed in a left rear direction, a weighted combination of other audio signals may produce a resultant audio signal that simulates an audio signal as if it were recorded by a directional microphone pointed in the left rear direction.

With industry standards in audio recording, such as A-format/B-format and matrix format, versatile recording devices may only include two to three microphones for recording audio, but through intensive calculations of the recorded audio signals, may produce audio signals for common surround channel playback (e.g., 5.1 surround). However, the intensive calculations are cumbersome and time-consuming, so smaller devices have difficulty with the processing power needed to handle such calculations. Further, because the weighted combinations of the original signals may necessarily include crosstalk between recording microphones, the resultant audio signals tend blend together so much that the directivity that true directional microphones can record is not simulated as well.

BRIEF DESCRIPTION OF THE DRAWINGS

The foregoing aspects and many of the attendant advantages of the claims will become more readily appreciated as the same become better understood by reference to the following detailed description, when taken in conjunction with the accompanying drawings, wherein:

DETAILED DESCRIPTION

Figure 1:
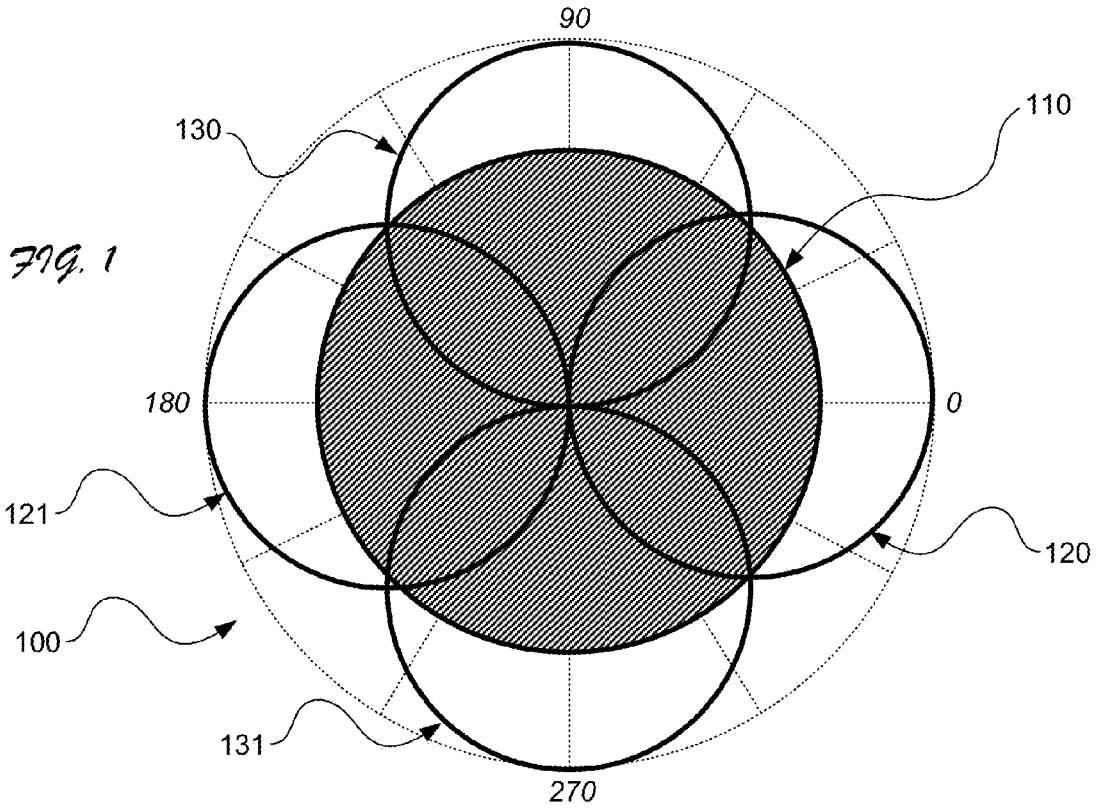
FIG. 1 shows a polar plot of microphone pickup patterns according to a B-format signal encoding method and system for recording audio.

The following discussion is presented to enable a person skilled in the art to make and use the subject matter disclosed herein. The general principles described herein may be applied to embodiments and applications other than those detailed above without departing from the spirit and scope of the present detailed description. The present disclosure is not intended to be limited to the embodiments shown, but is to be accorded the widest scope consistent with the principles and features disclosed or suggested herein.

By way of overview, an embodiment as described herein includes a system and method for generating virtual microphone signals having a particular number and configuration for channel playback from an intermediate set of signals that were recorded in an initial format that is different from the channel playback format. In one embodiment, an initial set of intermediate signals (which may be recorded audio from an array of microphones) are converted into the frequency domain with a respective fast-Fourier transform (FFT) block. In the frequency domain, the intermediate signals may be grouped into the corresponding Bark frequency-bands such that each intermediate signal may lead to a corresponding Bark-band power spectral density (PSD) signal representative of the initial intermediate signal. Likewise, one may generate Bark-band cross-correlations signals for each pair of intermediate signals. Next, from the PSDs and cross correlations, one may more efficiently calculate the PSDs of the virtual microphone signals corresponding to the signals to be used for playback on respective playback speakers. Thus, the virtual microphone signals may be generated at chosen angles (as well as other design factors). Further, each virtual microphone signal may also be further modified with a corresponding cancellation signal that further enhances the resultant signal in each channel, effectively reducing channel crosstalk. Thus, from the PSDs of the virtual microphone signal and cancellation signal for each channel, a channel gain is calculated at each Bark frequency-band. Applying these gains to the virtual microphone signals and converting these resultant channel signals back to a time domain then allows one to drive a set of playback speakers.

To this end, the system and method provides a more efficient means of calculating specific virtual playback channel signals from the initial set of intermediate signals. As is discussed in greater detail below, generating PSDs for each intermediate signal as well as cross-correlation for each intermediate signal pair yields fewer intensive calculations that solutions of the past perform. Then, PSD for each virtual channel signal may be more easily determined since each signal is a linear combination of the intermediate signal. In this manner, the intensive calculations are performed on the intermediate signals (which may be, in one embodiment, three signals) instead of on the resultant virtual channel signals (which may be five signals or more). As is discussed in greater detail below, the typical intermediate signals may be in common formats, such as a B-format (as is discussed with respect to FIG. 1) or a matrix format (as is discussed below with respect to FIG. 2) or any other format which records audio signals using an array of microphones.

FIG. 1 shows a polar plot 100 of microphone pickup patterns according to an A-format/B-format signal encoding method and system for recording audio. As is the case with all polar plots for microphone pickup patterns, the curved lines represent a −3 dB roll-off for a signal emanating from the primary pickup direction (or all directions in the case of an omnidirectional pickup pattern. The A-format/B-Format is one standard audio format whereby a set of signals may be produced by microphone array (often called a Soundfield array) arranged in a specific manner. This format is commonly referred to as just B-format. In particular, the B-format audio signals (which may be referred to throughout this disclosure as intermediate signals) may comprise the following signals:

W—an audio signal corresponding to the output from an omnidirectional microphone as shown by the polar pickup pattern 110.

X—an audio signal corresponding to a front-to-back directional pattern 120/121 that may be from a bi-directional microphone, such as a ribbon microphone. This pattern or type of microphone is sometimes also called a figure-of-eight pattern or microphone. In this signal, the front facing direction corresponds to a front lobe 120 in the 0° direction while the rear facing direction corresponds to a rear lobe 121 in the 180° direction.

Y—an audio signal corresponding to a side-to-side directional pattern 130/131 that may also be from a bi-directional microphone, e.g., a ribbon microphone. In this signal, the left facing direction corresponds to a left lobe 130 in the 90° direction while the right facing direction corresponds to a lobe 131 in the 270° direction.

In this embodiment, these three signals W, X, and Y may be used as intermediate signals for calculating a virtual signal from any direction (from 0° to 359°). For example, a forward-facing cardioid microphone may be simulated by combining the three signals in various weighted proportions. Using simple linear math, it is possible to simulate any number of first-order microphones, pointing in any direction, before and after recording. In other words, the B-format recording can be decoded to model any number of "virtual" microphones pointing in arbitrary directions. Each virtual microphone's pattern can be selected (e.g., different weightings in the calculations) to be omnidirectional, cardioid, hypercardioid, figure-of-eight, or anything in between. These and other calculations are discussed below with respect to FIG. 3*a*/3*b*.

Additionally, some embodiments may include a fourth signal (Z for example) that is another audio signal corresponding to a top-to-bottom directional pattern (not shown in any FIG.) that may also be from a bi-directional microphone, e.g., a ribbon microphone. In this signal, the top facing direction and the bottom facing direction may correspond to a third dimension in system that may model playback sound beyond two dimensions.

Figure 2:
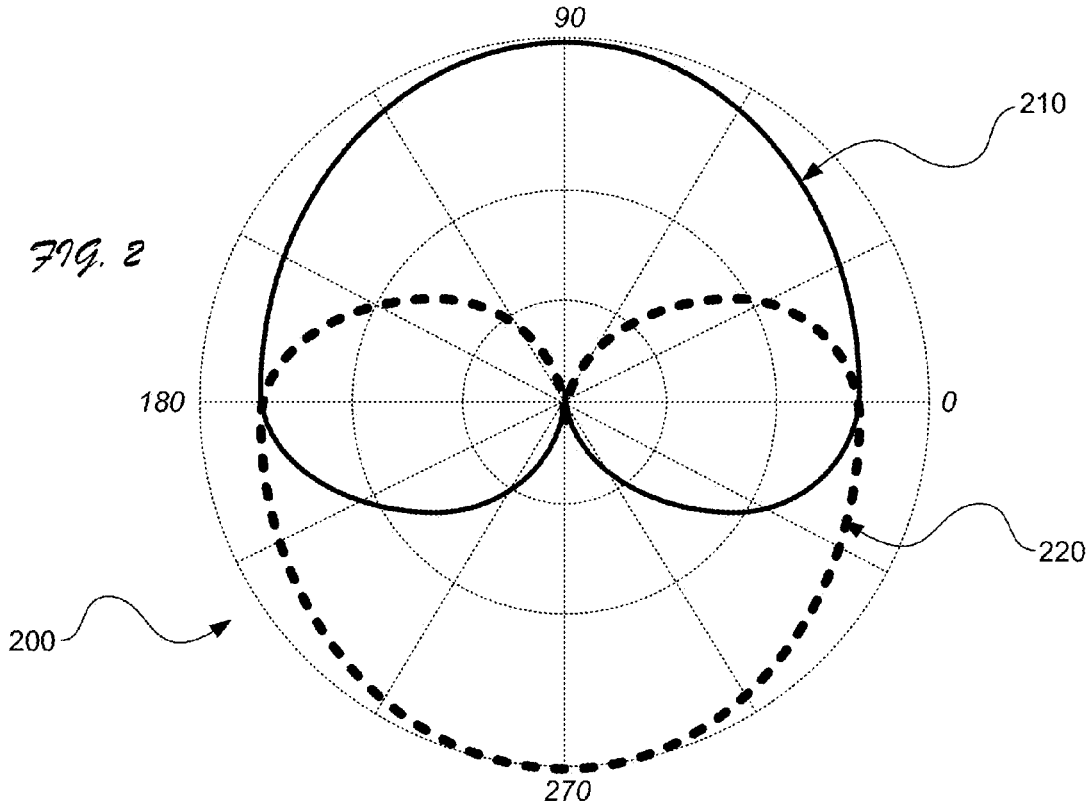
FIG. 2 shows a polar plot of microphone pickup patterns according to a matrix encoding method and system for recording audio.

FIG. 2 shows a polar plot of microphone pickup patterns 200 according to a matrix encoding method and system for producing audio. The matrix encoded format is another standard audio format whereby a set of audio signals may be produced to emulate a microphone array arranged in stereo pair configuration. In particular, the matrix encoded audio signals (which may be a different kind of intermediate signal as discussed above) may comprise the following signals:

Lt—an audio signal corresponding to the output from directional microphone pointed in the left direction (i.e., 90°) as shown by the polar pickup pattern 210.

Rt—an audio signal corresponding to the output from directional microphone pointed in the left direction (i.e., 270°) as shown by the polar pickup pattern 220.

In this embodiment, the audio signals Lt and Rt may be used as intermediate signals for calculating a virtual signal from any direction (from 0° to 359°) as discussed above. Further, the audio signals Lt and Rt may be the resultant directional response signals that are generated from other intermediate signals, such as the B-format signals discussed above. Again, each virtual microphone's pattern can be selected (e.g., different weightings in the calculations) to be omnidirectional, cardioid, hypercardioid, figure-of-eight, or anything in between. Again, these and other calculations are discussed below with respect to FIG. 3*a*/3*b*.

Figure 3A:
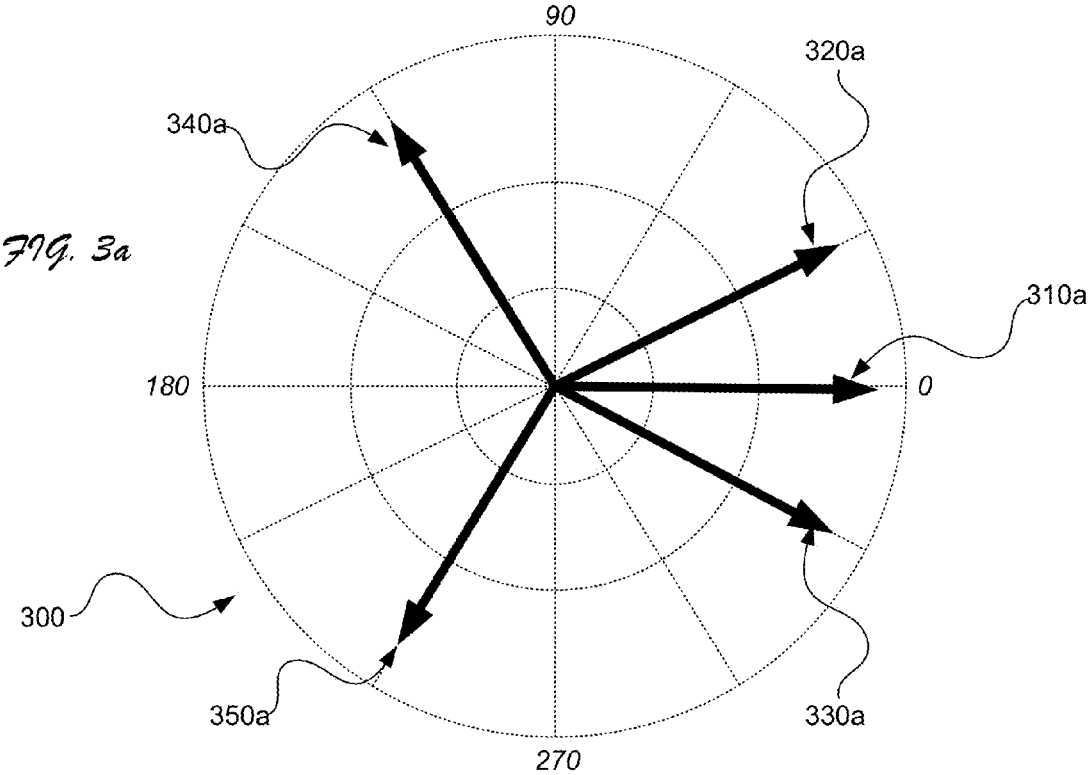
FIG. 3*a* shows a vector plot of desired directional signal surround sound pattern that may be derived from recorded audio that is recorded using a system and method discussed with respect FIGS. 1 and 2 according to an embodiment of the subject matter disclosed herein.

FIG. 3*a* shows a vector plot 300 of desired directional signal surround sound pattern (for a common five-channel surround system) that may be derived from recorded audio (intermediate signals) that is recorded using a system and method discussed with respect FIG. 1 or 2. As was briefly discussed above, common audio channel playback systems may include five channels to simulate the actual audio environment in which the audio was recorded. By manipulating the intermediate signals recorded, this example then yields five signals corresponding to a center channel signal 310*a*, a left channel signal 320*a*, a right channel signal 330*a*, a left-rear channel signal 340*a* and a right-rear channel signal 350*a*.

As is common (but not required), the center channel signal 310*a* is simulated at 0°. The left channel signal 320*a* is simulated at 30°s. The right channel signal 330*a* is simulated at 330°. The left-rear channel signal 340*a* is simulated at 110°. Lastly, the right-rear channel 350*a* is simulated at 250°. One way then to simulate audio signals for these five channels is to mathematically combine the intermediate signals W, X, and Y in specific weighted manners so as to simulate cardioid microphones pointed in these surround directions. This is shown in FIG. 3*b*.

Figure 3B:
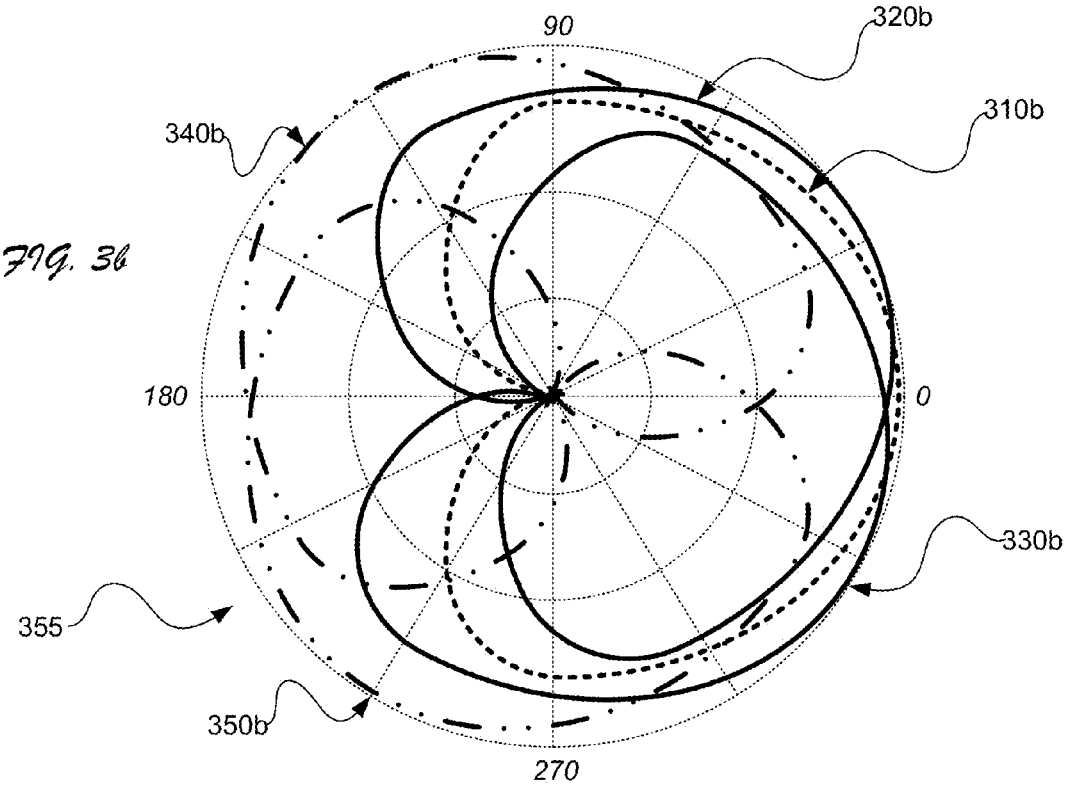
FIG. 3*b* shows a polar plot of desired directional signal surround sound pattern that may be derived from recorded audio that is recorded using a system and method discussed with respect FIGS. 1 and 2 according to an embodiment of the subject matter disclosed herein.

FIG. 3*b* shows a polar plot 355 of desired directional signal surround sound pattern that may be derived from recorded audio that is recorded using a system and method discussed with respect FIG. 1 or 2. In matching to the vectors of FIG. 3*a* then, once can see a cardioid polar pattern 310*b* that corresponds to the center channel signal 310*a* of FIG. 3*a*. This cardioid pattern 310*b* may then match a pickup pattern of a virtual microphone that produces a center channel audio signal; the center channel audio signal being a mathematical combination of the recorded intermediate signals. Similarly, the cardioid pattern 320*b* corresponds to a virtual microphone pickup pattern that would produce a left channel audio signal 320*a* (FIG. 3*a*). The cardioid pattern 330*b* corresponds to a virtual microphone pickup pattern that would produce a right channel audio signal 330*a* (FIG. 3*a*). The cardioid pattern 340*b* corresponds to a virtual microphone pickup pattern that would produce a left-rear channel audio signal 340*a* (FIG. 3*a*). Lastly, the cardioid pattern 350*b* corresponds to a virtual microphone pickup pattern that would produce a left channel audio signal 350*a* (FIG. 3*a*). To further illustrate how the intermediate signals may be combined to produce virtual channel signals, attention is now directed to the basic mathematical steps of producing virtual channel audio signals.

With the intermediate signals as discussed above, one may mathematical generate an audio signal that simulates that which would have been recorded by a microphone (i.e., a virtual microphone) if there had been a directional microphone pointed at a specific angle. That is, a directional response may be modeled from the intermediate signals that results in an audio signal for an audio channel that matches the angled location during playback (e.g., a left channel audio signal may be modeled at 30° for playback on a left channel speaker setting at a 30° angle with respect to a person listening). In the example of the B-format intermediate signals, the resultant audio signal at a specific angle θ may be modeled as weighted sum of each intermediate signal whereby:

$$W(\theta) = \frac{1}{\sqrt{2}}$$

$$X(\theta) = \frac{1+\cos(\theta)}{2}$$

$$Y(\theta) = \frac{1+\sin(\theta)}{2}$$

In the example of matrix-encoded intermediate signals the directional response may be modeled as:

$$Lt(\theta) = \cos\left(\frac{\theta-90}{2}\right)$$

$$Rt(\theta) = \sin\left(\frac{\theta-90}{2}\right)$$

The directional response of B-format and matrix-encoded signals may be manipulated in a channel-coefficient matrix and combined to produce the desired multi-channel surround sound signals. In one embodiment, the virtual microphone matrixing method may be calculated as follows:

$$\begin{bmatrix} C_1(n) \\ C_2(n) \\ \vdots \\ C_P(n) \end{bmatrix} = \begin{bmatrix} \gamma S_1, C_1 & \cdots & \gamma S_M, C_1 \\ \gamma S_1, C_2 & \cdots & \gamma S_M, C_2 \\ \vdots & \ddots & \vdots \\ \gamma S_1, C_P & \cdots & \gamma S_M, C_P \end{bmatrix} \cdot \begin{bmatrix} S_1(n) \\ \vdots \\ S_M(n) \end{bmatrix}$$

where $S_i(n)$ (i=1, 2, . . . , M) is the M intermediate signals, $C_j(n)$ (j=1, 2, . . . , P) is the virtual microphone signals corresponding to the P playback channels, n is the sample index, and $\gamma_{S_i,C_j}$ is the channel-coefficient for intermediate signal $S_i(n)$ and playback channel signal $C_j(n)$. As an illustration, the channel-coefficient design solutions to derive a virtual microphone signal with directivity $d_{C_j}$ pointing to a direction α° from B-format signals is:

$$C_j^\alpha(n) = \gamma_{W,C_j^\alpha} \cdot W + \gamma_{X,C_j^\alpha} \cdot X + \gamma_{Y,C_j^\alpha} \cdot Y$$

$$\gamma_{W,C_j^\alpha} = \frac{1}{\sqrt{2}} \cdot (2 - d_{C_j})$$

$$\gamma_{X,C_j^\alpha} = \frac{1}{2} \cdot d_{C_j} \cdot \cos(\alpha)$$

$$\gamma_{Y,C_j^\alpha} = \frac{1}{2} \cdot d_{C_j} \cdot \sin(\alpha)$$

For matrix-encoded signals, the solution may be:

$$C_j^\alpha(n) = \gamma_{L_t,C_j^\alpha} \cdot Lt(n) + \gamma_{R_t,C_j^\alpha} \cdot Rt(n)$$

$$\gamma_{L_t,C_j^\alpha} = \cos\left(\frac{\alpha - \pi/2}{2}\right)$$

$$\gamma_{R_t,C_j^\alpha} = \sin\left(\frac{\alpha - \pi/2}{2}\right)$$

Thus, one can see the pickup pattern that is calculated to generate the resultant audio signals in FIG. 3*b* as an example of directional response of the signals for common surround sound playback, derived from the B-format signals. The B-format signals are matrixed into five virtual cardioid signals pointing to the direction of 30° (left channel 320*b*), 330° (right channel 330*b*), 0° (center channel 310*b*), 110° (left-rear channel 340*b*) and 250° (right-rear channel 350*b*). A similar directional response of the playback channel signals derived from matrix-encoded signals, with different virtual microphone orientation, may also be generated—resulting in the same plot 355 in FIG. 3*b*. Further, although not shown on the plot of FIG. 3*b* (to keep this plot from becoming unreadable) additional signals representing yet more surround channels may be present. For example, a left-fill channel at 90° and a right-fill channel at 270°—commonly found in seven-channel surround systems.

Further yet, the type of microphone pickup pattern may also be modeled in these equation with directivity factor $d_{Cj}$. This factor refers to the directivity of the virtual microphone, i.e., the shape of the lobe and ranges from 0 to 2. For example, an omnidirectional pickup pattern would be modeled with a directivity value of 0. A cardioid (directional) pattern has a directivity value of 1 and bidirectional (figure of 8) has directivity value of 2.

In looking at the polar plots of the virtual microphones commonly associated with a five-channel surround system in FIG. 3*b*, one can see a great amount of overlap between channels. For example, the center channel plot 310*b* overlaps significantly with both the left channel plot 320*b* and the right channel plot 330*b*. Thus, one can understand how the mathematical combination of the intermediate signals may result in very big differences in the resultant audio signal. As a result, a person has difficulty distinguishing between the center channel, left channel and right channel since the resultant audio signals are so similar. This is called stereo collapse and has the effect of making the surround sound signals sound less "wide" (i.e., closer to monaural ("mono") sound wherein each channel comprises the same audio signal instead of the desired stereo or surround effect).

One way to reduce the amount of crosstalk between channels that are close together in directional angle is to apply a mathematical correction technique that has the effect of narrowing the lobe of a virtual microphone pickup pattern. In this sense, one may think of the technique in terms of changing a virtual cardioid microphone to a virtual hypercardioid microphone or virtual shotgun microphone having a narrower lobe for a pickup pattern. This mathematical technique is described below with respect to FIG. 4.

Figure 4:
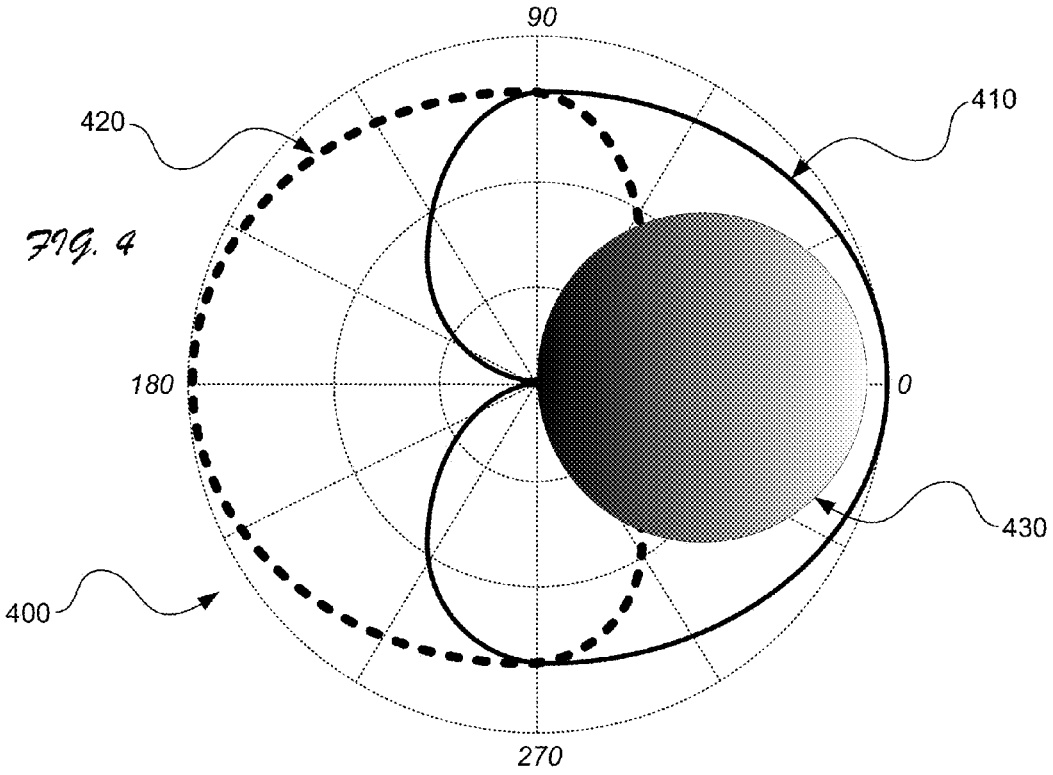
FIG. 4 shows a polar plot of a resultant directional pickup pattern of a virtual microphone when a cancellation method is used according to an embodiment of the subject matter disclosed herein.

FIG. 4 shows a polar plot 400 of a resultant directional pickup pattern 430 of a virtual microphone when a lobe cancellation technique is used. Lobe cancellation, in general terms, utilizes an analysis of the relative strength of different frequency bands of the audio signal itself to eliminate some of the audio signal. In this sense, relatively weaker portions of signals at different frequencies may be subtracted from the original signal which has the effect of "narrowing" the lobe of the polar pickup pattern. In terms of the polar plot 400, one can see a polar pickup pattern for an original signal as shown by the lobe 410. In generating a cancellation signal to be used to cancel some of the signal, the audio signal is reversed so as to create an equal but opposite cancellation signal as if it were recorded from a microphone with the polar pickup pattern 420. By combining the original signal and the cancellation signal according to the method described below, a resultant signal is generated that corresponds to the shaded polar pickup pattern 430 of FIG. 4. Different resultant signals may be generated that yield signal as if from different polar patterns, but in the following mathematical example in the next paragraphs, this particular polar pickup pattern 430 is modeled.

One may then generate five different audio signals corresponding to five different virtual microphone locations by manipulating the three intermediate signals as discussed above. Then, with the five new "unnarrowed" audio signals, one may generate five cancellation signals corresponding to the five virtual microphone signals. Finally, one may subtract the cancellation signal from the virtual microphone signal to arrive at a set of five resultant audio signals with better directivity and imaging than originally calculated without lobe cancellation. Manipulating five (or more) sets of audio signals in various time/frequency domain calculations is time-consuming and calculation intensive (as will be seen below). A better and novel approach is to perform the frequency domain lobe cancellation technique before generating the virtual microphone signals. That is, the lobe cancellation calculations are performed on the intermediate signals (only 3 signals in the B-format example and only two signals in the matrix-encoded example). Then, one may generate the five (or more) resultant audio signals that correspond to the virtual microphone placement. A device with a processing path for accomplishing this more efficient way of generating virtual surround sound audio is shown and described below with respect to FIG. 5.

Figure 5:
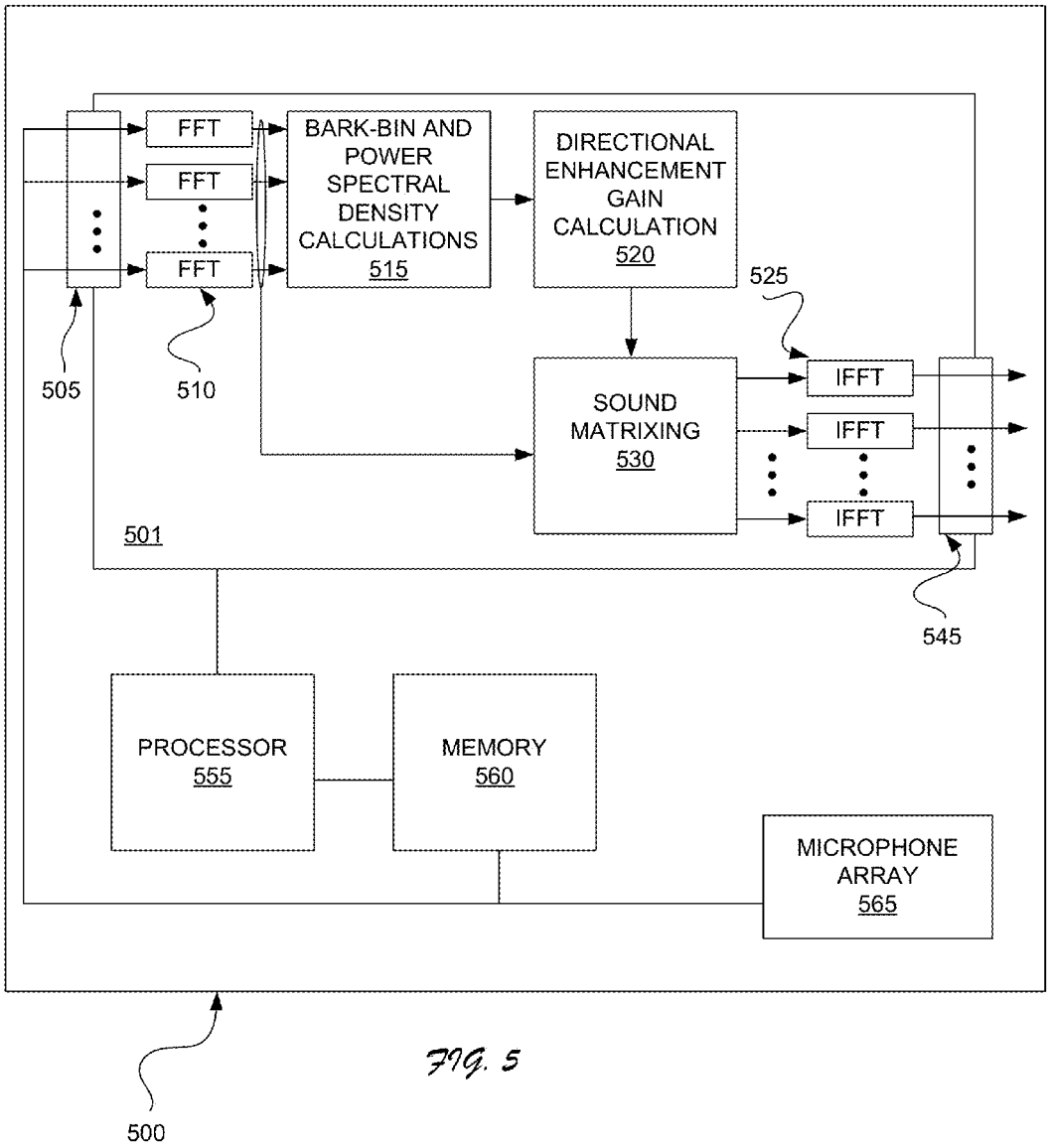
FIG. 5 shows a block diagram of a system for efficiently manipulating intermediate audio signals to produce resultant audio signals for use in a surround sound system according to an embodiment of the subject matter disclosed herein.

FIG. 5 shows a block diagram of a system 500 for efficiently manipulating intermediate audio signals to produce resultant audio signals for use in a surround sound system according to an embodiment of the subject matter disclosed herein. The system 500 may be an audio recording platform, a video recording device, a camcorder device, a personal computer, an audio workstation or any other processing device whereby audio signals may be processed into surround sound signals.

In the example embodiment of FIG. 5, the device 500 includes a processor 555 coupled to a memory 560. The processor is configured to control storage to the memory 560 and retrieval therefrom. Further, the processor may be coupled to a sound processing circuit 501 which may be in the form of an integrated circuit formed on a single die. In some embodiments, the sound processor 501 may be formed on two or more separate integrated circuit dies. Further, the processor 555 and the sound processing circuit 501 may be coupled to a microphone array 565. The microphone array 565 may be a Soundfield microphone array configured to generate initial intermediate signals in a B-format from ambient sounds in a recording environment.

When audio is received at the microphone array, audio signals are generated that may be stored in the memory 560 for later processing and playback. Alternatively, the audio signals may be sent directly to the sound processing device to an audio input stage 505. In the case of retrieving the intermediate signals from the memory 560, the intermediate signals are still received at the sound processing circuit 501 at the audio input stage 505. The audio input stage 505 may comprise any number of signal inputs. In this embodiment and example, three inputs as shown may correspond to the B-format intermediate signals W, X, and Y as discussed above. However, as is common, the inputs may be numerous such that the input signals are multiplexed and overlapped across many inputs in the audio input stage 505. Thus, the intermediate signals, through the audio input stage 505 are introduced to the sound processing circuit 501.

The intermediate signals are recorded and stored as digital signals. Thus, a sample rate is associated with the sound processing circuit 501 and expressed in terms of a time domain signal. That is, the intermediate signals may be samples at a rate to match the rate of the processing circuitry internal to the sound processing circuit 501. In this example, the sample rate may be 48 kHz and data may be handled in blocks of 1024 samples which, in turn, corresponds to the number of sample points of the Fast-Fourier Transform (FFT) blocks 510 FFT. Further, the FFT blocks 510 may also process input signals using an overlapping technique whereby better performance can be obtained if one overlaps received blocks of audio input data. For example, the first FFT block may process samples 1 thru 1024, but then the second FFT block may overlap the first block by 50%, so that the second FFT block would include samples 512 through 1536. Generally, the greater the amount of overlap, the higher the reproduced-signal quality, but at the cost the more calculations, and thus the more processing time and energy. 50% overlap has been found to be a good balance between quality and speed, but is noted that other percentages may be used as well as other overlapping techniques such as a time-frequency filter bank method which is known and not described further herein.

Once the input audio has been through the FFT blocks 510, another processing block 515 applies a Bark-banding and power calculation. An FFT block 510, as described above, may include a bin for each frequency that is a multiple of the first harmonic. Thus, for a discreet sampled signal, the frequency components of that signal include the first harmonic of that signal plus multiples of that harmonic. As a theoretical maximum then, to have a 1024-point FFT, then one may represent the audio input signal as having 512 frequency harmonics. In this theoretical example, the harmonics are of the inverse of the time length of the block. So in other words, a block of 1024 samples has a time period T, and 1/T is the first harmonic, 2/T is the second harmonic, etc.

Handling 512 bins in the frequency domain would cause an impractical level processing to occur. Thus, a particular technique has been developed to alleviate the processing requirements and this known technique is called Bark-banding. In a Bark-banding method, the 512 theoretical bins are divided down into a smaller number of groups of bins. For example, the 512 individual frequency bins are divided into 20 groups or frequency bands, and these 20 groups are called Bark-bands. So in this example, each Bark-band includes about 25 frequency bins. As is commonly practiced in Bark-banding, each Bark-band does not have the same number of frequency bins, and actual Bark-band groupings have been studied and settled as a specific distribution that approximately matches the manner in which a human perceives audio. Notwithstanding the known method of Bark-banding to distribute frequency bins, any method of reducing the total processing required to determine the frequency and harmonics of the audio input signals may be used here.

Next, the power spectral density (PSD) for each of the intermediate signals (continuing the example her, the W, X, and Y signals) and the cross correlation value between each pair of the intermediate signals may be calculated. With these calculations (described a bit further below), the resulting power spectral densities for each channel and each cancellation signal may be calculated according the following equation:

$$PSD_{ch}(i,b)=\sqrt{|S_{ch}(i,b)|^2}$$
$$=\sqrt{\left(\sum_{j=k_b}^{k_{b+1}-1}|\gamma_{W,ch}\cdot W(i,j)+\gamma_{X,ch}\cdot X(i,j)+\gamma_{Y,ch}\cdot Y(i,j)|^2\right)}$$
$$=\sqrt{(\gamma_{W,ch}^2PW(i,b)+\gamma_{X,ch}^2PX(i,b)+\gamma_{Y,ch}^2PY(i,b)+2\cdot(\gamma_{W,ch}\gamma_{X,ch}CWX(i,b)+\gamma_{W,ch}\gamma_{Y,ch}CWY(i,b)+\gamma_{X,ch}\gamma_{Y,ch}CXY(i,b)))}$$

In this equation, to calculate the power spectral density of the W signal, the index i represents (for the block of samples), and the index b represents the bark band index. So, for example, if there are 20 Bark-bands, then PW (i, b) will be a 20 element vector. Furthermore, the quantity $k_b$ is the bin reference, and $k_{b+1}$ is the next Bark-band reference. So the summation in this equation is over all of the frequency bins within a Bark-band. For example, the first Bark-band may include the frequency bins 1 thru 10. Thus, b would equal 1 and $K_b$ would also equal 1. Now $K_{b+1}$ would equal 11, and then on the top of the summation symbol the summation limit would be 11−1=10. So this would be the sum, over the frequency bins 1 thru 10, of the square of the W signal. So again the power spectral density PW is going to be a 20 element vector. However, each vector element is the sum of the signal powers at each of the frequencies within the Bark-band.

Therefore, to calculate the PSD for each intermediate signal PW(i,b), PX(i,b) and PY(i,b) and each cross-correlation signal CWX(i,b), CWY(i,b) and CXY(i,b) one may calculate according to:

$$PW(i,b)=\sum_{j=k_b}^{k_{b+1}-1}|W(i,j)|^2$$

$$PX(i,b)=\sum_{j=k_b}^{k_{b+1}-1}|X(i,j)|^2$$

$$PY(i,b)=\sum_{j=k_b}^{k_{b+1}-1}|Y(i,j)|^2$$

$$CWX(i,b)=\sum_{j=k_b}^{k_{b+1}-1}(W(i,j)\cdot X*(i,j))$$

$$CWY(i,b)=\sum_{j=k_b}^{k_{b+1}-1}(W(i,j)\cdot Y*(i,j))$$

-continued $$CXY(i,b)=\sum_{j=k_b}^{k_{b+1}-1}(X(i,j)\cdot Y*(i,j))$$

where '*' denotes complex conjugate. These bark-bin power and cross-correlation values, together with the channel-coefficients, may then be used to calculate the PSD of all main output-channel signals as well as the cancellation signals as shown in the Power Spectral Density equation as discussed above. Performing these difficult and power consuming calculations on the initial intermediate signals is more efficient than waiting until the output channel signals are generated from the intermediate signals. This is because there are typically three signals (in the case of B-format intermediate signals) used in the difficult calculations as opposed to five or more (in the case of surround signals in a five or seven output channel format).

Once these PSDs are determined for the intermediate signals as well as the cross-correlation values, these modified signals may then be used to generate any channel signal along with a corresponding cancellation signal without the need for the calculation-intensive Bark-banding method to be used at the channel signal level. Thus, any channel signal ch may be calculated in a directional enhancement and gain calculation block 530 using the intermediate signal PSDs and the cross-correlation values as discussed above.

Herein, the index ch is used to refer to any of the output channels (i.e., ch=left, right, center, left-rear, or right-rear). The main and cancellation signals' channel-coefficient may be designed according to direction (the angle of the virtual microphone) and directivity (the polar pattern of the virtual microphone). As an example, for front left channel, the main signal may have a cardioid directivity pointing to a direction of 30° (location of front left speaker in the five-channel surround sound playback configuration) while the cancellation signal has cardioid directivity pointing to the 210° direction.

Once the channel-coefficient $[\gamma_{W,ch}, \gamma_{X,ch}, \gamma_{Y,ch}]_{main}$ and $[\gamma_{W,ch}, \gamma_{X,ch}, \gamma_{Y,ch}]_{cncel}$ are designed, the PSD of the main and cancellation signals $PSD_{ch,main}(i,b)$ and $PSD_{ch,cancel}(i,b)$ are calculated according to the equation discussed above. The cancellation gain at each bark bin, which is the amount of attenuation applied to the frequency region to reduce the channel crosstalk, is calculated according to:

$$\text{gain}_{ch}(i,b)=\frac{PSD_{ch,main}(i,b)-cFac\cdot PSD_{ch,cancel}(i,b)}{PSD_{ch,main}(i,b)}$$

where cFac is a parameter to control the amount of cancellation. Thus cFac may be a parameter that can be manipulated during manufacture only or may a factor that an end-user may manipulate to acquire different cancellation aspects wherein one can manipulate to give the desired cancellation.

Further, the bark-bin gain values are subsequently mapped to the corresponding FFT-bin according to:

$$\text{gainFFT}_{ch}(i,k)=\text{gain}_{ch}(i,b_k)$$

where $b_k$ is the bark-bin index b which corresponds to FFT-bin index k. Once one has calculated the Bark-band gains, one can map it to the FFT gain. That is, with the Bark-bands and gain values for Bark-bands, one can expand this out resulting in a gain value for each frequency bin. Thus, if there are 20 Bark-bands and 512 frequency bins, one expands the 20 Bark-bands back into the 512 frequency bins. This may be done relatively simply, by assigning to each frequency bin within a Bark-band the gain value that was calculated for the Bark-band. For example, if the gain for the first Bark-band is 10, then to expand this out, the gain for each frequency bin within the first Bark-band would also be set to 10. The value of gain might change abruptly between adjacent FFT bins and may cause undesired artifacts. To prevent unwanted artifacts, such as spectral hole or musical noise, the gain may be limited as well as smoothed over time by use of known compression, limiting and filtering methods.

With the gains calculated for each FFT channel at each bark bin, one may then construct a set of surround sound signals in the frequency domain in a sound matrixing block 530 according to:

$$\begin{bmatrix} C_1(i,k) \\ C_2(i,k) \\ \vdots \\ C_P(i,k) \end{bmatrix} = diag\left(gainFFT_{C_1}(i,k),\ gainFFT_{C_2}(i,k),\ \ldots\ ,\ gainFFT_{C_P}(i,k)\right)\cdot \begin{bmatrix} \gamma S_1, C_1 & \cdots & \gamma S_M, C_1 \\ \gamma S_1, C_2 & \cdots & \gamma S_M, C_2 \\ \vdots & \ddots & \vdots \\ \gamma S_1, C_P & \cdots & \gamma S_M, C_P \end{bmatrix} \cdot \begin{bmatrix} S_1(i,k) \\ \vdots \\ S_M(i,k) \end{bmatrix}$$

Here, each overall channel signal Cx may be calculated using the channel FFT gains as well as the initial intermediate signals Sx as modified by the gamma signals corresponding to the coefficients of the main or cancellation signals as designed, for example, according to a surround sound channel design as discussed above with respect to FIG. 3. Accordingly, the calculated FFT gains may be applied to the normal coefficient matrix to, in effect, combine the coefficient matrix with the gain matrix to simultaneously generate the virtual microphone signals and narrow the lobes of these resultant channel signals. This equation is then repeated k times in order to get a Fourier vector for each virtual microphone signal in the frequency domain. Then, the FFT vectors for each virtual microphone signal may be run through an inverse Fast-Fourier Transform (IFFT) block 525 to get the virtual microphone signal in the time domain. These signals may then be carried off-chip through an output audio block 545 and are the signals that are actually converted from digital form into analog form to drive channels (speakers) which may commonly be a five-channel or a seven-channel surround sound system.

While the subject matter discussed herein is susceptible to various modifications and alternative constructions, certain illustrated embodiments thereof are shown in the drawings and have been described above in detail. It should be understood, however, that there is no intention to limit the claims to the specific forms disclosed, but on the contrary, the intention is to cover all modifications, alternative constructions, and equivalents falling within the spirit and scope of the claims.

What is claimed is:

1. A method, comprising:

receiving intermediate signals that are representative of audio;

generating cross-correlation values based upon the intermediate signals, each cross-correlation value uniquely associated with two respective intermediate signals; and generating a plurality of channel signals as a function of respective power spectral densities of the intermediate signals and respective power spectral densities of the cross-correlation values, such that the power spectral density of each cross-correlation value is calculated based upon a function of each input intermediate signal and the correlation values between each two intermediate signals.

2. The method of claim 1, further comprising:

receiving the intermediate signals in a time domain; and transforming the received intermediate signals into a frequency domain.

3. The method of claim 1, wherein receiving the intermediate signals further comprises:

receiving a first intermediate signal representative of audio from an omnidirectional point source that generates an omnidirectional signal;

receiving a second intermediate signal representative of audio from a first bidirectional point source that generates a bidirectional signal having an axis, the bidirectional; and receiving a third intermediate signal representative of audio from a second bidirectional point source that generates a bidirectional signal having an axis that is perpendicular to the axis of the second intermediate signal.

4. The method of claim 3, wherein receiving the intermediate signals further comprises receiving a fourth intermediate signal representative of audio from a third bi-directional point source that generates a bidirectional signal having an axis that is perpendicular to the axis of the second intermediate signal and perpendicular to the axis of the third intermediate signal.

5. The method of claim 1, wherein receiving the intermediate signals further comprises:

receiving a first intermediate signal representative of audio from a first directional point source that generates a first directional signal; and receiving a second intermediate signal representative of audio from a second directional point source that generates a second directional signal that is a different direction that the first directional signal.

6. The method of claim 5, wherein the first intermediate signal and the second intermediate signal comprise directional signals with corresponding directional angles that are 180 degrees away from each other.

7. The method of claim 1, wherein generating the channel signals further comprises generating each channel signal as a function of an angle, the angle corresponding to a direction for channel playback.

8. The method of claim 7, wherein generating the channel signals further comprises:

generating a center channel signal having a relative direction of zero degrees;

generating a left channel signal having a relative direction of 30 degrees;

generating a right channel signal having a relative direction of 330 degrees;

generating a left-rear channel signal having a relative direction of 110 degrees; and generating a right-rear channel signal having a relative direction of 250 degrees.

9. The method of claim 8, wherein generating the channel signals further comprises:

generating a left-fill channel signal having a relative direction of 90 degrees; and generating a right-fill channel signal having a relative direction of 270 degrees.

10. The method of claim 1, wherein the generating cross-correlation values further comprises generating a cross-correlation value for each pair of intermediate signals as a mathematical function of the pair of intermediate signals.

11. A method, comprising:

receiving intermediate signals that are representative of audio;

generating cross-correlation values based upon the intermediate signals, each cross-correlation value uniquely associated with two respective intermediate signals; and generating a plurality of channel signals as a function of the intermediate signals and cross-correlation values;

wherein the generating the channel signals further comprises:

bark-banding each intermediate signal; and generating a power spectral density signal corresponding to each bark-banded intermediate signal;

calculating bark-band cross-correlation values for each pair of intermediate signals;

generating a bark-band power-spectral density main signal corresponding to each channel as a linear function of each power spectral density signal and each cross-correlation value;

generating a bark-band power-spectral density cancellation signal corresponding to each channel as a linear function of each power spectral density signal and each cross-correlation value; and calculating a channel gain value as a function of the bark-band power-spectral density main signal and bark-band power-spectral density cancellation signal.

12. The method of claim 11, further comprising calculating the channel gain value as a function of weighting of coefficients corresponding to the intermediate signals.

13. An integrated circuit, comprising:

an input circuit configured to receive intermediate signals;

a correlation calculation circuit configured to generate a correlation signal between every two intermediate signals; and a channel signal generation circuit configured to generate channel signals as a function of respective power spectral densities of the intermediate signals and respective power spectral densities of the cross-correlation signals, such that the power spectral density of each cross-correlation signal is calculated based upon a function of each intermediate signal and the correlation values between each two intermediate signals.

14. The integrated circuit of claim 13, further comprising a power-spectral density calculation circuit configured to:

generate bark-band signals for each intermediate signal; and generate a power spectral density signal corresponding to each bark-banded intermediate signal; and calculate bark-band cross-correlation values for each pair of intermediate signals.

15. The integrated circuit of claim 14, further comprising an output circuit configured to output the channel signals to a device external to the integrated circuit.

16. The integrated circuit of claim 14, further comprising:

a Fast-Fourier transform block configured to transform the received intermediate signals from a time-domain signal into a frequency-domain signal; and an inverse Fast-Fourier transform block configured to transform the channel signals from a frequency-domain signal into a time-domain signal.

17. The integrated circuit of claim 14 disposed on a single integrated circuit die.

18. The integrated circuit of claim 14 disposed on multiple integrated circuit dies.

19. The integrated circuit of claim 14, further comprising:

a bark-banding circuit configured to perform a bark-banding operation on each received intermediate signal; and a power spectral density calculation circuit configured to determine a power spectral density for each bark-banded intermediate signal and configured to determine a power spectral density for each correlation signal.

20. The integrated circuit of claim 14, further comprising a sound matrixing circuit configured to calculate a gain signal for each channel signal that is a function of the power spectral density of an intermediate signal and the power spectral density of a correction signal.

21. The integrated circuit of claim 13, wherein the audio input circuit comprises three inputs configured to receive B-format audio signals.

22. The integrated circuit of claim 13, wherein the audio input circuit comprises two inputs configured to receive matrix-encoded audio signals.

23. An integrated circuit, comprising:

an input circuit configured to receive intermediate signals;

a correlation calculation circuit configured to generate a correlation signal between every two intermediate signals; and a channel signal generation circuit configured to generate channel signals from the intermediate signals and the correlation signals;

the integrated circuit further comprising a directional enhancement gain calculation circuit configured to:

generate a bark-band power-spectral density main signal corresponding to each channel as a linear function of each power spectral density signal and each cross-correlation value;

generate a bark-band power-spectral density cancellation signal corresponding to each channel as a linear function of each power spectral density signal and each cross-correlation value; and calculate a channel gain value as a function of the bark-band power-spectral density main signal and bark-band power-spectral density cancellation signal.

24. A method, comprising:

generating a plurality of output audio signals from a plurality of input audio signals such that the plurality of output audio signals are greater in number than the plurality of input audio signals, the generation of the output audio signals based upon a calculation of a power spectral density of the input audio signals and based upon a power spectral density of a cancellation signal for each output audio signal;

wherein the power spectral density of the cancellation signal of each output audio signal is calculated based upon a function of each input audio signal and a correlation value between each two input audio signals.

25. The method of claim 24, wherein the calculation of the power spectral density comprises:

bark-banding each audio input signal and calculating the power spectral density from each bark-banded audio input signal according to the equations:

$$PW(i, b) = \sum_{j=k_b}^{k_{b+1}-1} |W(i, j)|^2$$

$$PX(i, b) = \sum_{j=k_b}^{k_{b+1}-1} |X(i, j)|^2$$

-continued $$PY(i, b) = \sum_{j=k_b}^{k_{b+1}-1} |Y(i, j)|^2$$

where each audio input signal corresponds to one of W, X and Y.

26. The method of claim 25, wherein the correlation values are calculated according to the equations:

$$CWX(i, b) = \sum_{j=k_b}^{k_{b+1}-1} (W(i, j) \cdot X*(i, j))$$

$$CWY(i, b) = \sum_{j=k_b}^{k_{b+1}-1} (W(i, j) \cdot Y*(i, j))$$

$$CXY(i, b) = \sum_{j=k_b}^{k_{b+1}-1} (X(i, j) \cdot Y*(i, j))$$

where each audio input signal corresponds to one of W, X and Y.

27. The method of claim 26, wherein each output audio signal comprises a main component and a cancellation component, the cancellation component corresponding to the cancellation value, each main component and cancellation component is calculated according to the equation:

$$PSD_{ch}(i, b) = \sqrt{|\gamma_{ch}(i, b)|^2}$$

$$= \sqrt{\left(\sum_{j=k_b}^{k_{b+1}-1} |\gamma_{W,ch} \cdot W(i, j) + \gamma_{X,ch} \cdot X(i, j) + \gamma_{Y,ch} \cdot Y(i, j)|^2\right)}$$

$$= \sqrt{(\gamma_{W,ch}^2 PW(i, b) + \gamma_{X,ch}^2 PX(i, b) + \gamma_{Y,ch}^2 PY(i, b) + 2 \cdot (\gamma_{W,ch}\gamma_{X,ch} CWX(i, b) + \gamma_{W,ch}\gamma_{Y,ch} CWY(i, b) + \gamma_{X,ch}\gamma_{Y,ch} CXY(i, b)))}$$

where, the index i represents a block of samples, the index b represents the bark band index, the quantity $k_b$ represents a bin reference, and $k_{b+1}$ represents a next Bark-band reference.

28. The method of claim 27, further comprising calculating a cancellation gain at each bark bin, according to the equation:

$$\text{gain}_{ch}(i, b) = \frac{PSD_{ch,main}(i, b) - cFac \cdot PSD_{ch,cancel}(i, b)}{PSD_{ch,main}(i, b)}$$

where cFac is a parameter to control the amount of cancellation.

29. The method of claim 28, further comprising mapping the bark-bin gain values to corresponding FFT-bins according to the equation:

$$\text{gainFFT}_{ch}(i,k) = \text{gain}_{ch}(i,b_k).$$

30. The method of claim 29, further comprising generating a set of surround sound audio signals from the output audio signals according to the equation:

$$\begin{bmatrix} C_1(i, k) \\ C_2(i, k) \\ \vdots \\ C_P(i, k) \end{bmatrix} = diag\left(gainFFT_{C_1}(i, k), gainFFT_{C_2}(i, k), \ldots, gainFFT_{C_P}(i, k)\right) \cdot \begin{bmatrix} \gamma S_1, C_1 & \cdots & \gamma S_M, C_1 \\ \gamma S_1, C_2 & \cdots & \gamma S_M, C_2 \\ \vdots & \ddots & \vdots \\ \gamma S_1, C_P & \cdots & \gamma S_M, C_P \end{bmatrix} \cdot \begin{bmatrix} S_1(i, k) \\ \vdots \\ S_M(i, k) \end{bmatrix}.$$

31. A sound processing platform, comprising:

an input block for receiving intermediate signals that are representative of audio;

a processing block for generating cross-correlation values based upon the intermediate signals, each cross-correlation value uniquely associated with two respective intermediate signals; and an output block for generating a plurality of channel signals as a function of respective power spectral densities of the intermediate signals and respective power spectral densities of the cross-correlation values, such that the power spectral density of each cross-correlation value is calculated based upon a function of each input intermediate signal and the correlation values between each two intermediate signals.

32. The sound processing platform of claim 31, wherein receiving the intermediate signals further comprises:

recording a first intermediate signal representative of audio from an omnidirectional point source that generates an omnidirectional signal;

recording a second intermediate signal representative of audio from a first bidirectional point source that generates a bidirectional signal having an axis, the bidirectional; and recording a third intermediate signal representative of audio from a second bidirectional point source that generates a bidirectional signal having an axis that is perpendicular to the axis of the second intermediate signal.

33. The sound processing platform of claim 31, wherein generating the channel signals further comprises generating each channel signal as a function of an angle, the angle corresponding to a direction for channel playback.

34. The sound processing platform of claim 33, wherein generating the channel signals further comprises:

generating a center channel signal having a relative direction of zero degrees;

generating a left channel signal having a relative direction of 30 degrees;

generating a right channel signal having a relative direction of 330 degrees;

generating a left-rear channel signal having a relative direction of 110 degrees; and generating a right-rear channel signal having a relative direction of 250 degrees.

35. The sound processing platform of claim 31, wherein the generating cross-correlation values further comprises generating a cross-correlation value for each pair of intermediate signals as a mathematical function of the pair of intermediate signals.

36. The sound processing platform of claim 31 comprising a video recording device.

37. The sound processing platform of claim 31 comprising a downmixer.

38. The sound processing platform of claim 31 comprising a digital audio workstation.

39. A sound processing platform, comprising:

an input block for receiving intermediate signals that are representative of audio;

a processing block for generating cross-correlation values based upon the intermediate signals, each cross-correlation value uniquely associated with two respective intermediate signals; and an output block for generating a plurality of channel signals as a function of the intermediate signals and cross-correlation values;

wherein the generating the channel signals further comprises:

bark-banding each intermediate signal; and generating a power spectral density signal corresponding to each bark-banded intermediate signal;

calculating bark-band cross-correlation values for each pair of intermediate signals;

generating a bark-band power-spectral density main signal corresponding to each channel as a linear function of each power spectral density signal and each cross-correlation value;

generating a bark-band power-spectral density cancellation signal corresponding to each channel as a linear function of each power spectral density signal and each cross-correlation value; and calculating a channel gain value as a function of the bark-band power-spectral density main signal and bark-band power-spectral density cancellation signal.

40. The sound processing platform of claim 39, further comprising calculating the channel gain value as a function of weighting of coefficients corresponding to the intermediate signals.

* * * * *

UNITED STATES PATENT AND TRADEMARK OFFICE

CERTIFICATE OF CORRECTION

PATENT NO. : 8,873,762 B2
APPLICATION NO. : 13/210048
DATED : October 28, 2014
INVENTOR(S) : Sapna George Samsudin et al.

It is certified that error appears in the above-identified patent and that said Letters Patent is hereby corrected as shown below:

In the Claims

In Claim 4, Column 12, line 40 of the patent, please change the hyphenated text "bi-directional" to -- bidirectional --

In Claim 27, Column 15, lines 52 through 67 of the patent, please delete the claim 27 and substitute with the following readable version of claim 27:

-- 27. The method of claim 26, wherein each output audio signal comprises a main component and a cancellation component, the cancellation component corresponding to the cancellation value, each main component and cancellation component is calculated according to the equation:

$$PSD_{ch}(i,b) = \sqrt{\left|S_{ch}(i,b)\right|^2}$$

$$= \sqrt{\left(\sum_{j=k_b}^{k_{b+1}-1} \left|\gamma_{W,ch} \cdot W(i,j) + \gamma_{X,ch} \cdot X(i,j) + \gamma_{Y,ch} \cdot Y(i,j)\right|^2\right)}$$

$$= \sqrt{\left(\gamma_{W,ch}{}^2 PW(i,b) + \gamma_{X,ch}{}^2 PX(i,b) + \gamma_{Y,ch}{}^2 PY(i,b) + 2 \cdot \left(\gamma_{W,ch}\gamma_{X,ch} CWX(i,b) + \gamma_{W,ch}\gamma_{Y,ch} CWY(i,b) + \gamma_{X,ch}\gamma_{Y,ch} CXY(i,b)\right)\right)}$$

where, the index i represents a block of samples, the index b represents the bark band index, the quantity kb represents a bin reference, and kb+1 represents a next Bark-band reference. --

In Claim 32, Column 16, line 49 through 50 of the patent, please delete the text ", the bidirectional"

Signed and Sealed this
Fifth Day of May, 2015

Michelle K. Lee

Michelle K. Lee
*Director of the United States Patent and Trademark Office*